US009644914B2

(12) United States Patent
Pysarenko

(10) Patent No.: US 9,644,914 B2
(45) Date of Patent: May 9, 2017

(54) TRIGGER MECHANISM FOR A PISTOL

(71) Applicant: Viktor Pysarenko, Vinnitsya (UA)

(72) Inventor: Viktor Pysarenko, Vinnitsya (UA)

( * ) Notice: Subject to any disclaimer, the term of this patent is extended or adjusted under 35 U.S.C. 154(b) by 0 days.

(21) Appl. No.: 14/913,990

(22) PCT Filed: Jan. 24, 2014

(86) PCT No.: PCT/UA2014/000007

§ 371 (c)(1),
(2) Date: Feb. 23, 2016

(87) PCT Pub. No.: WO2015/030692

PCT Pub. Date: Mar. 5, 2015

(65) Prior Publication Data

US 2016/0209142 A1 Jul. 21, 2016

(30) Foreign Application Priority Data

Aug. 27, 2013 (UA) ..... 201310455

(51) Int. Cl.

| | |
|---|---|
| ***F41A 3/00*** | (2006.01) |
| ***F41A 19/10*** | (2006.01) |
| ***F41A 17/72*** | (2006.01) |
| ***F41A 19/14*** | (2006.01) |

(52) U.S. Cl.

CPC ..... *F41A 19/10* (2013.01); *F41A 17/72* (2013.01); *F41A 19/14* (2013.01)

(58) Field of Classification Search

USPC ..... 42/41, 42.01, 14, 42.03, 69.01, 69.02; 89/150, 154, 136, 27.11

See application file for complete search history.

(56) References Cited

U.S. PATENT DOCUMENTS

| | | | | |
|---|---|---|---|---|
| 6,865,979 | B1 | 3/2005 | Vaid | |
| 8,176,836 | B2 * | 5/2012 | Peev | F41A 19/32 42/69.02 |
| 8,464,455 | B2 * | 6/2013 | Kallio | F41A 17/02 42/70.06 |
| 2002/0194762 | A1 | 12/2002 | Cominolli | |
| 2006/0048428 | A1 | 3/2006 | Thomele | |
| 2011/0289811 | A1 | 12/2011 | Gentilini | |
| 2015/0027020 | A1 * | 1/2015 | Sheets, Jr. | F41A 17/46 42/70.11 |
| 2016/0076842 | A1 * | 3/2016 | Faxon | F41A 17/22 42/69.01 |

* cited by examiner

*Primary Examiner* — J. Woodrow Eldred
(74) *Attorney, Agent, or Firm* — Weiner & Burt, P.C; Irving M. Weiner; Pamela S. Burt

(57) ABSTRACT

A pistol having a sliding hammer (5), a trigger mechanism including a trigger rod (2), an automatic safety (10) which can engage said sliding hammer (5) and a two armed lever (8) rotatably mounted on an axis (15) for operating the automatic safety (10) by means of a first arm (9), said trigger rod (2) having a rear end which is bent to a form a horizontal part, said horizontal part comprising: a first alignment edge (3) which engages a hammer ledge (4) on said sliding hammer (5) and a second alignment edge (6) which engages a hollow (7) in a second arm (11) of the two armed lever (8).

16 Claims, 3 Drawing Sheets

TRIGGER MECHANISM FOR A PISTOL

Invention refers to the armament industry, namely to the trigger mechanism of the pistol with percussion firing mechanism.

The trigger mechanism of the pistol with percussion firing mechanism, at the trigger pull, ensures the trigger arming and release, which transfers the energy to the firing pin and strikes the primer.

Most similar analog of the announced invention is the trigger mechanism of the "GLOCK 17" pistol (electronic internet-encyclopedia "Wikipedia"; gunmagazine.com "Pistol GLOCK 17"), which consists of the trigger connected with the rod, which has two horizontal bends, disconnecting unit, performed with the guiding slot and a flap for the rod fixation at the rear position as well as the ledges on the inner top surface of the slide for the rod fixation release and back spring, which adjacent to the rear rod side at one end and mounts to the inner frame end faces by the other end.

The structural complexity and big distance between the lateral barrel axis and rear ledge of the pistol grip, specified by the disconnecting unit dimensions, which negatively influences on the pistol accuracy parameters may be considered as disadvantages of such trigger mechanism.

At the hart of invention is the goal to develop the trigger mechanism with considerably smaller dimensions in comparison with the analog on the basis of the known trigger mechanism.

Set task solution is ensured that the pistol trigger mechanism, which consists of the trigger, connected with the rod and performed with two horizontal bends, one of which is situated before the hammer ledge and other ensures the automatic safety switch, at that to the rear side of the rod the back spring is attached, the other side of which is attached to the inner frame end face surface, located in lateral vertical slot of the disconnecting unit frame, performed with the guiding slot, rear face of the rod is sliding on it, the rod is fixed by its ledges in the hole, performed in the disconnecting unit, at that the rod fixation is released by the inner slide ledge, which bends off the top side of the disconnecting unit and differs in the fact that it located in rear side of disconnecting unit frame slot, performed as the toggle fixed on the axis, one arm of which ensures the automatic safety switch and other has a hollow for interaction with the rod, which performed at rear side with horizontal bend having two connecting bands; one band is located before the hammer ledge and other intrudes into the toggle hollow.

The fact that the disconnecting unit is performed as the toggle fixed on the axis, allows to simplify the structure and to decrease the distance between the lateral barrel axis and rear lower grip ledge, ensuring therewith the shooters hand approach to the lateral barrel axis of the pistol, whereby the aiming accuracy after the first and next shoots is improved.

Figure 1:
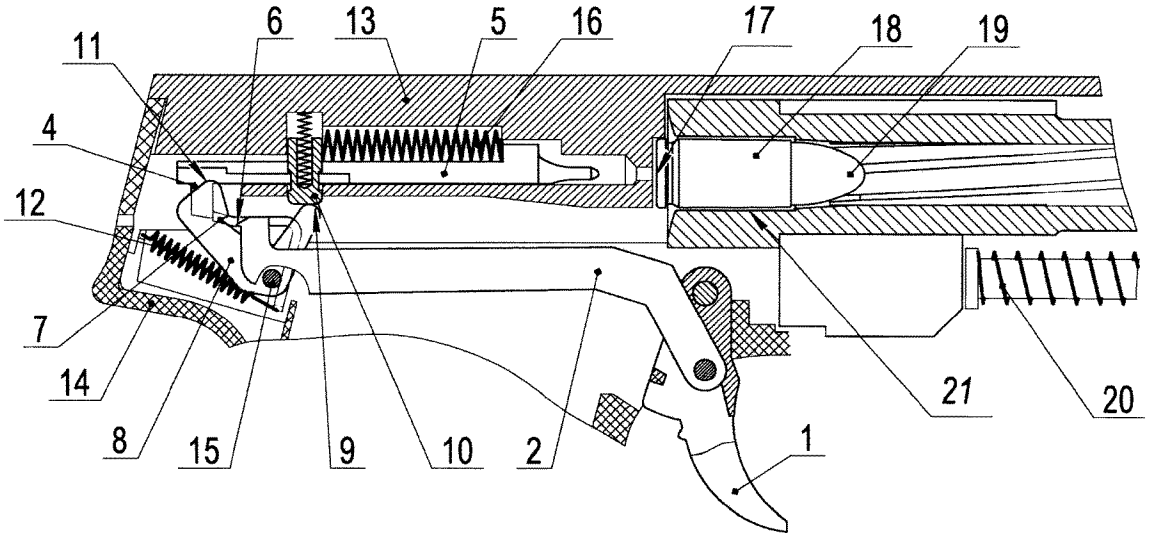

The invention essence is shown on figures:

FIG. 1—trigger mechanism cross section before the shot (the slide is in forward position).

Figure 2:
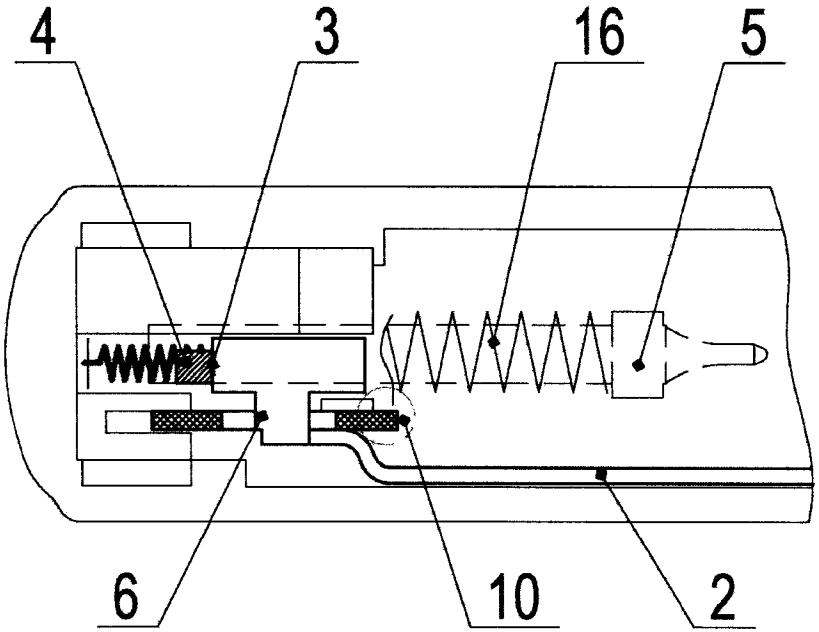

FIG. 2—trigger mechanism topside view.

Figure 3:
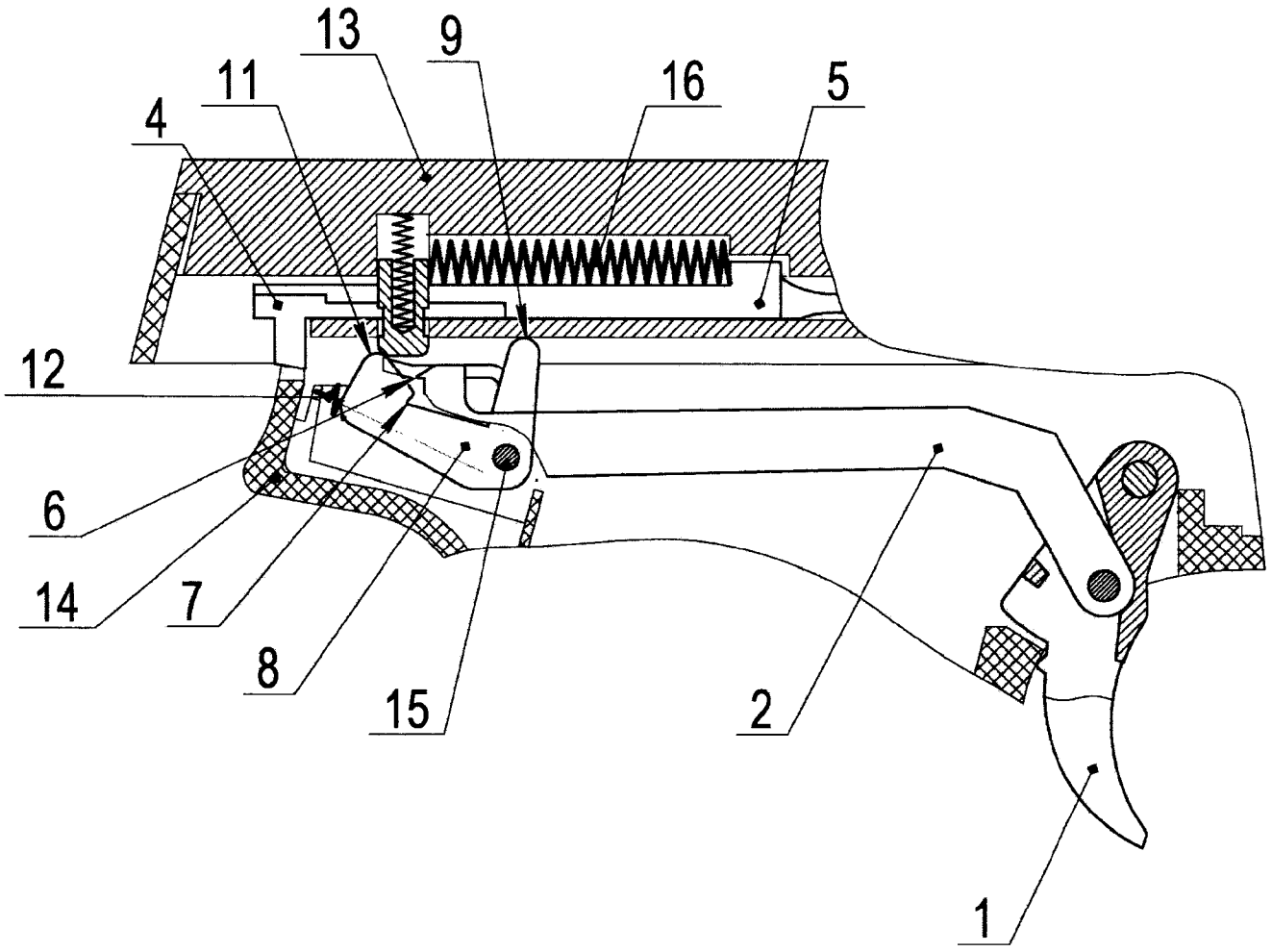

FIG. 3—trigger mechanism section (slide in the rearmost position).

Announced trigger mechanism of the pistol consists of the trigger 1 with the rod 2 attached, read end of which is bended horizontally and has the alignment edge 3 and the alignment edge 6, the disconnecting unit is performed as the fixed toggle 8 with the turn possibility on the axis 15, which has arm 9 for the automatic safety 10 switch and arm 11 with hollow 7. The rear side of the rod 2 is under the back spring

12 pressure, which attached to the frame 14 by one end and to the rear bottom side of the rod 2 by another end.

The Trigger Mechanism Position at the Trigger Pull and Release

At the trigger 1 pull, the rod 2 is moving back. The edge 6 intrudes the hollow 7 of the toggle 8 and turns the toggle 8 about axis 15, at that the toggle 8 arm 9 pushes the automatic safety 10 ledge and throws out of engagement with the hammer 5 and releases the hammer 5, simultaneously the rod 2 edge 3 pushes the hammer 5 ledge 4 in hammer 5 spring 16 pressing direction. The rod 2 continues to move back by its edge 6, turns the toggle 8 so, that the arm 11 of the toggle 8 goes below the hammer 5 ledge 4. Released hammer 5 under the preliminary pressed spring 16 action, strikes the primer 17 of the cartridge 18, located in the cartridge chamber 21, and here comes the shot. Powder gases, generated at shot, push the bullet 19 forward through the barrel, at that, the slide 13 is moving backwards, presses the recoil spring 20 and strikes the toggle 8 arm 11 with safety, at that the rod 2 edge 6 de-meshes from the hollow 7 of the toggle 8 and rear end of the rod 2 under the back spring 12 action goes up, simultaneously the rod 2 edge 3 seats over against the hammer 5 ledge 4. When the recoil spring 20 expands, the slide 13 is moving forward, the automatic safety 10 presses the toggle 8 arm 9, at that the toggle 8 arm 11 turns so, that the toggle 8 hollow 7 seats over against the rod 2 edge 6.

At the trigger 1 release, the rod 2 is moving forward, the rod 2 edge 3 together with hammer 5 ledge 4 moves forward, at that the hammer 5 spring 16 compresses slightly. The trigger mechanism is ready for the shot again.

The described invention allows to improve the sight shooting accuracy parameters after the first and next shots and to simplify the mechanism structure.

Reference design bundle is developed for the proposed trigger mechanism structure, design is technologically processed. Pistol test samples with described trigger mechanism are manufactured and tested, testing results are positive.

The invention claimed is:

1. A trigger mechanism apparatus for a pistol with a percussion firing mechanism, comprising, in combination:

a slidable hammer;

a trigger mechanism including a trigger rod, an automatic safety device that is engageable with said slidable hammer, and a two-armed toggle lever rotatably mounted on an axle for operating said automatic safety device by way of a first arm of said two-armed toggle lever;

said trigger rod having a rear end portion which is bent to form a horizontal portion;

said horizontal portion of said trigger rod includes a first alignment edge which engages a hammer ledge of said slidable hammer; and said horizontal portion of said trigger rod includes a second alignment edge which engages a hollow portion in a second arm of said two-armed toggle lever.

2. The apparatus of claim 1, including:

a back spring having a first end attached to a frame of the apparatus, and having a second end attached to a rear bottom side of said trigger rod; and whereby said rear bottom side of said trigger rod is subjected to a spring pressure from said back spring.

3. The apparatus of claim 1, wherein:

said trigger mechanism includes a trigger pivotally attached to said trigger rod so that when said trigger is pulled said trigger rod is moved backwardly, said second alignment edge intrudes into said hollow portion in said second arm of said two-armed toggle lever and turns said two-armed toggle lever about said axle, and said first arm of said two-armed toggle lever pushes said first alignment edge of said automatic safety device to release said slidable hammer.

4. The apparatus of claim 2, wherein:

said trigger mechanism includes a trigger pivotally attached to said trigger rod so that when said trigger is pulled said trigger rod is moved backwardly, said second alignment edge intrudes into said hollow portion in said second arm of said two-armed toggle lever and turns said two-armed toggle lever about said axle, and said first arm of said two-armed toggle lever pushes said first alignment edge of said automatic safety device to release said slidable hammer.

5. The apparatus of claim 1, including:

a slide member;

a cartridge chamber;

a cartridge disposed in said cartridge chamber;

said cartridge having a bullet and a primer;

a pistol barrel;

a recoil spring;

a hammer spring pressing said slidable hammer forwardly toward said primer of said cartridge disposed in said cartridge chamber;

said trigger mechanism includes a trigger pivotally attached to said trigger rod so that when said trigger is pulled said trigger rod is moved backwardly, said second alignment edge intrudes into said hollow portion of said two-armed toggle lever and turns said two-armed toggle lever about said axle, and said first arm of said two-armed toggle lever pushes said first alignment edge of said automatic safety device to release said slidable hammer;

said first alignment edge pushes said hammer ledge in the hammer spring pressing direction;

said trigger rod continues to move so that said second arm of said two-armed toggle lever moves below said hammer ledge; and the released slidable hammer urged by a spring pressure action of said hammer spring strikes said primer of said cartridge, releasing powder gases to push said bullet forwardly through said barrel of the pistol.

6. The apparatus of claim 2, including:

a slide member;

a cartridge chamber;

a cartridge disposed in said cartridge chamber;

said cartridge having a bullet and a primer;

a pistol barrel;

a recoil spring;

a hammer spring pressing said slidable hammer forwardly toward said primer of said cartridge disposed in said cartridge chamber;

said trigger mechanism includes a trigger pivotally attached to said trigger rod so that when said trigger is pulled said trigger rod is moved backwardly, said second alignment edge intrudes into said hollow portion of said two-armed toggle lever and turns said two-armed toggle lever about said axle, and said first arm of said two-armed toggle lever pushes said first alignment edge of said automatic safety device to release said slidable hammer;

said first alignment edge pushes said hammer ledge in the hammer spring pressing direction;

said trigger rod continues to move so that said second arm of said two-armed toggle lever moves below said hammer ledge; and the released slidable hammer urged by a spring pressure action of said hammer spring strikes said primer of said cartridge, releasing powder gases to push said bullet forwardly through said barrel of the pistol.

7. The apparatus of claim 3, including:

a slide member;

a cartridge chamber;

a cartridge disposed in said cartridge chamber;

said cartridge having a bullet and a primer;

a pistol barrel;

a recoil spring;

a hammer spring pressing said slidable hammer forwardly toward said primer of said cartridge disposed in said cartridge chamber;

said first alignment edge pushes said hammer ledge in the hammer spring pressing direction;

said trigger rod continues to move so that said second arm of said two-armed toggle lever moves below said hammer ledge; and the released slidable hammer urged by a spring pressure action of said hammer spring strikes said primer of said cartridge, releasing powder gases to push said bullet forwardly through said barrel of the pistol.

8. The apparatus of claim 4, including:

a slide member;

a cartridge chamber;

a cartridge disposed in said cartridge chamber;

said cartridge having a bullet and a primer;

a pistol barrel;

a recoil spring;

a hammer spring pressing said slidable hammer forwardly toward said primer of said cartridge disposed in said cartridge chamber;

said first alignment edge pushes said hammer ledge in the hammer spring pressing direction;

said trigger rod continues to move so that said second arm of said two-armed toggle lever moves below said hammer ledge; and the released slidable hammer urged by a spring pressure action of said hammer spring strikes said primer of said cartridge, releasing powder gases to push said bullet forwardly through said barrel of the pistol.

9. The apparatus of claim 1, including:

a slide member;

a recoil spring; and whereby when said recoil spring expands, said slide member moves forwardly, and said automatic safety device presses said first arm of said two-armed toggle lever turning said second arm of said two-armed toggle lever so that said hollow portion in said second arm of said two-armed toggle lever seats over against said second alignment edge of said trigger rod.

10. The apparatus of claim 2, including:

a slide member;

a recoil spring; and whereby when said recoil spring expands, said slide member moves forwardly, and said automatic safety device presses said first arm of said two-armed toggle lever turning said second arm of said two-armed toggle lever so that said hollow portion in said second arm of said two-armed toggle lever seats over against said second alignment edge of said trigger rod.

11. The apparatus of claim 3, including:

a slide member;

a recoil spring; and whereby when said recoil spring expands, said slide member moves forwardly, and said automatic safety device presses said first arm of said two-armed toggle lever turning said second arm of said two-armed toggle lever so that said hollow portion in said second arm of said two-armed toggle lever seats over against said second alignment edge of said trigger rod.

12. The apparatus of claim 4, including:

a slide member;

a recoil spring; and whereby when said recoil spring expands, said slide member moves forwardly, and said automatic safety device presses said first arm of said two-armed toggle lever turning said second arm of said two-armed toggle lever so that said hollow portion in said second arm of said two-armed toggle lever seats over against said second alignment edge of said trigger rod.

13. The apparatus of claim 5, wherein:

when said recoil spring expands, said slide member moves forwardly, and said automatic safety device presses said first arm of said two-armed toggle lever turning said second arm of said two-armed toggle lever so that said hollow portion in said second arm of said two-armed toggle lever seats over against said second alignment edge of said trigger rod.

14. The apparatus of claim 6, wherein:

when said recoil spring expands, said slide member moves forwardly, and said automatic safety device presses said first arm of said two-armed toggle lever turning said second arm of said two-armed toggle lever so that said hollow portion in said second arm of said two-armed toggle lever seats over against said second alignment edge of said trigger rod.

15. The apparatus of claim 7, wherein:

when said recoil spring expands, said slide member moves forwardly, and said automatic safety device presses said first arm of said two-armed toggle lever turning said second arm of said two-armed toggle lever so that said hollow portion in said second arm of said two-armed toggle lever seats over against said second alignment edge of said trigger rod.

16. The apparatus of claim 8, wherein:

when said recoil spring expands, said slide member moves forwardly, and said automatic safety device presses said first arm of said two-armed toggle lever turning said second arm of said two-armed toggle lever so that said hollow portion in said second arm of said two-armed toggle lever seats over against said second alignment edge of said trigger rod.

* * * * *